US006015780A

United States Patent [19]

Llosas Bigorra et al.

[11] Patent Number: 6,015,780

[45] Date of Patent: Jan. 18, 2000

[54] FORMULATIONS FOR CLEANING HARD SURFACES COMPRISING A BETAINE SURFACTANT HAVING EXACTLY 12 CARBON ATOMS

[75] Inventors: Joaquin Llosas Bigorra, Sabadell; Nuria Bonastre Gilabert, Barberá del Vallés; Miguel Osset Hernandez, Barcelona; Xavier Closa Cruxens, S. Cugat del vallés; Rafael Pi Subirana, Granollers, all of Spain

[73] Assignee: Henkel Kommanditgesellschaft auf Aktien, Duesseldorf, Germany

[21] Appl. No.: 09/057,348

[22] Filed: Apr. 8, 1998

[30] Foreign Application Priority Data

Apr. 8, 1997 [DE] Germany ..... 197 14 369

[51] Int. Cl.[7] ..... C11D 1/90; C11D 1/12; C11D 3/22

[52] U.S. Cl. ..... 510/237; 510/235; 510/123; 510/356; 510/362; 510/470; 510/490; 510/503; 510/426

[58] Field of Search ..... 510/235, 237, 510/470, 490, 503, 123, 362, 426, 356

[56] References Cited

U.S. PATENT DOCUMENTS

| | | | |
|---|---|---|---|
| 5,476,614 | 12/1995 | Adamy et al. | 252/544 |
| 5,503,779 | 4/1996 | Adamy et al. | 252/546 |
| 5,578,560 | 11/1996 | Giesen et al. | 510/237 |
| 5,750,097 | 5/1998 | Leidreiter et al. | 424/70.1 |
| 5,807,816 | 9/1998 | Cottrell et al. | 510/235 |
| 5,874,393 | 2/1999 | Drapier et al. | 510/417 |

FOREIGN PATENT DOCUMENTS

| | | |
|---|---|---|
| 0 341 071 | 11/1989 | European Pat. Off. . |
| WO91/11506 | 8/1991 | WIPO . |

OTHER PUBLICATIONS

SÖFW—Journal 122: 674 (1996)
Seifen–Öle–Fette–Wachse 108: 373–76 (1982).
A. O'Lennick, et al., HAPPI 70 (Nov. 1986).
S. Holzman, et al., Tens. Det. 23: 309–13 (1986).
R. Bibo, et al., Soap Cosm. Chem. Spec. 46 (Apr. 1990).
P. Ellis, et al., Euro Cosm. 1: 14–16 (1994).
Fette, Seifen Anstrichmitt. 74: 163–65 (1972).
DIN 53902 (Dec. 1977).

*Primary Examiner*—Yogendra Gupta
*Assistant Examiner*—Charles Boyer
*Attorney, Agent, or Firm*—Ernest G. Szoke; Wayne C. Jaeschke; Steven J. Trzaska

[57] ABSTRACT

A surfactant composition containing: (a) from 2 to 20% by weight of a betaine having a fatty residue containing exactly 12 carbon atoms; (b) from 3 to 18% by weight of an alkyl and/or alkenyl oligoglycoside; and (c) from 15 to 35% by weight of a fatty alcohol ether sulfate, all weights being based on the weight of the composition.

16 Claims, No Drawings

FORMULATIONS FOR CLEANING HARD SURFACES COMPRISING A BETAINE SURFACTANT HAVING EXACTLY 12 CARBON ATOMS

BACKGROUND OF THE INVENTION

This invention relates to formulations for cleaning hard surfaces which consist of lauryl-based betaines, glycosides, fatty alcohol (ether) sulfates and optionally other surfactants. The invention also relates to the use of lauryl aminobetaines or lauric acid amidoalkylbetaines as sole betaine components for the production of formulations for cleaning hard surfaces.

Consumers expect formulations for cleaning hard surfaces, such as dishwashing detergents or multipurpose cleaners for example, to meet a number of requirements. Thus, the formulations must of course have adequate cleaning power, must foam even in hard water and in the presence of oils, must show sufficiently high viscosity so that they are easy to dispense in measured quantities and do not immediately flow off vertical surfaces and, finally, must be particularly compatible with the skin despite the pronounced detergent properties required.

Formulations designed for these tasks often contain combinations of alkyl glucosides and fatty alcohol ether sulfates, optionally in admixture with amphoteric surfactants of the betaine type. For example, International patent application WO 94/09102 (Henkel) describes aqueous surfactant concentrates containing 5 to 20% by weight of alkyl glucosides, 25 to 40% by weight of fatty alcohol sulfates, 35 to 65% by weight of fatty alcohol ether sulfates and 5 to 20% by weight of amphoteric surfactants derived from fatty amines or fatty acid amidoamines with a C chain distribution of 6 to 22. Dishwashing detergents containing these substances are also known from International patent application WO 91/11506 (Henkel). H. Leidreiter and U. Maczkiewitz report on synergistic effects between alkyl glucosides, betaines and ether sulfates in SÖFW-Journal 122,674(1996).

Nevertheless, there is a constant market demand for formulations which exhibit improved performance properties in relation to the prior art. The problem addressed by the present invention was to provide such formulations.

BRIEF SUMMARY OF THE INVENTION

The present invention relates to formulations for cleaning hard surfaces consisting of (a) 2 to 20 and preferably 5 to 15% by weight of betaines containing exactly 12 carbon atoms in the fatty residue, (b) 3 to 18 and preferably 5 to 15% by weight of alkyl and/or alkenyl oligoglycosides, (c) 15 to 35 and preferably 20 to 25% by weight of fatty alcohol (ether) sulfates, (d) 0 to 5 and preferably 1 to 3% by weight of fatty alcohol ethoxylates and (e) 0 to 5 and preferably 1 to 3% by weight of amine oxides, with the proviso that the quantities shown add up to 100% by weight with water.

DETAILED DESCRIPTION OF THE INVENTION

It has surprisingly been found that, within certain quantity ratios, the replacement of betaines with a C chain distribution of 12 to 18 or 12 to 14 by similar, laurylbased betaines with a C chain length of exactly 12 carbon atoms produces a significant improvement in cleaning and foaming power.

Betaines

The betaines which form component (a) are known surfactants which are mainly produced by carboxyalkylation, preferably carboxymethylation, of aminic compounds. The starting materials are preferably condensed with halocarboxylic acids or salts thereof, more particularly sodium chloroacetate, one mole of salt being formed per mole of betaine. The addition of unsaturated carboxylic acids, such as acrylic acid for example, is also possible. Information on nomenclature and, in particular, on the difference between betaines and "true" amphoteric surfactants can be found in the Article by U. Ploog in Seifen-Öle-Fette-Wachse, 108; 373 (1982). Further overviews on this subject have been published, for example, by A. O'Lennick et al. in HAPPI, Nov. 70 (1986), by S. Holzman et al. in Tens. Det. 23, 309 (1986), by R. Bibo et al. in Soap. Cosm. Chem. Spec. Apr. 46 (1990) and by P. Ellis et al. in Euro Cosm. 1, 14 (1994). Examples of suitable betaines are the carboxyalkylation products of secondary and, in particular, tertiary amines which correspond to formula (I):

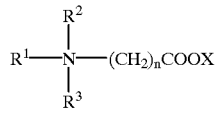

(I)

where $R^1$ is a dodecyl radical, $R^2$ is hydrogen or an alkyl group containing 1 to 4 carbon atoms, $R^3$ is an alkyl group containing 1 to 4 carbon atoms, n is a number of 1 to 6 and X is an alkali and/or alkaline earth metal or ammonium. Typical examples are the carboxymethylation products of dodecyl methylamine, dodecyl dimethylamine, dodecyl ethylmethylamine and technical mixtures thereof.

Other suitable betaines are the carboxyalkylation products of amidoamines which correspond to formula (II):

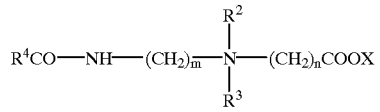

(II)

in which $R^4CO$ is a lauroyl group, m is a number of 1 to 3 and $R^2$, $R^3$, n and X are as defined above. Typical examples are reaction products of lauric acid with N,N-dimethylaminoethylamine, N,N-dimethylaminopropylamine, N,N-diethylaminoethylamine and N,N-diethylaminopropylamine which are condensed with sodium chloroacetate. A condensation product of lauric acid-N,N-dimethylaminopropylamide with sodium chloroacetate is preferably used.

Other suitable starting materials for the betaines to be used for the purposes of the invention are imidazolines. These substances are also known and may be obtained, for example, by cyclizing condensation of 1 or 2 moles of lauric acid with polyfunctional amines, such as for example aminoethyl ethanolamine (AEEA) or diethylenetriamine. The corresponding carboxyalkylation products are mixtures of different open-chain betaines. Typical examples are condensation products of the above-mentioned fatty acids with AEEA, preferably imidazolines based on lauric acid, which are subsequently betainized with sodium chloroacetate.

Alkyl and/or Alkenyl Oligoglycosides

The alkyl and alkenyl oligoglycosides which form component (b) are known nonionic surfactants which correspond to formula (III):

$$R^5O—[G]_p \quad (III)$$

where $R^5$ is an alkyl and/or alkenyl radical containing 4 to 22 carbon atoms, G is a sugar unit containing 5 or 6 carbon atoms and p is a number of 1 to 10. They may be obtained by the relevant methods of preparative organic chemistry, for example by acid-catalyzed acetalization of glucose with fatty alcohols. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (III) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^5$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxo synthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^5$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil fatty alcohol having a DP of 1 to 3 are preferred.

Fatty Alcohol (ether) Sulfates

Fatty alcohol sulfates and fatty alcohol ethers sulfates (component c) are known anionic surfactants which are industrially manufactured by sulfation of primary alcohols or ethylene oxide adducts thereof with $SO_3$ or chlorosulfonic acid (CSA) and subsequent neutralization. Fatty alcohol (ether) sulfates corresponding to formula (IV):

$$R^6O—(CH_2CH_2O)_aSO_3X \quad (IV)$$

where $R^6$ is a linear or branched alkyl and/or alkenyl group containing 6 to 22 carbon atoms, a is 0 or a number of 1 to 10 and X is an alkali and/or alkaline earth metal, ammonium, alkyl ammonium, alkanolammonium or glucammonium. Typical examples of fatty alcohol sulfates are the sulfates of caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof in the form of their sodium and/or magnesium salts. Typical examples of fatty alcohol ether sulfates are the sulfation products of the adducts of on average 1 to 10 and more particularly 2 to 5 moles of ethylene oxide with the above-mentioned alcohols. Cocofatty alcohol ether sulfate and fatty alcohol ether sulfates based on adducts of on average 2 to 3 moles of ethylene oxide with technical $C_{12/14}$ or $C_{12/18}$ cocofatty alcohol fractions in the form of their sodium and/or magnesium salts are particularly preferred.

Fatty Alcohol Ethoxylates

Fatty alcohol ethoxylates may optionally be present as component (d) and are known nonionic surfactants which are industrially manufactured by base-catalyzed addition of ethylene oxide to primary alcohols. Ethoxylates corresponding to formula (V):

$$R^7O—(CH_2CH_2O)_bH \quad (V)$$

where $R^7$ is a linear or branched alkyl and/or alkenyl group containing 6 to 22 carbon atoms and b is a number of 1 to 10. Typical examples are adducts of on average 1 to 10 and, more particularly, 2 to 5 moles of ethylene oxide with caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof. The ethoxylates may have both a conventional and a narrow homolog distribution. Adducts of on average 2 to 3 moles of ethylene oxide with technical $C_{12/14}$ or $C_{12/18}$ cocofatty alcohol fractions are particularly preferred.

Amine Oxides

Finally, the formulations according to the invention may contain amine oxides as an optional component (e). Amine oxides are produced from tertiary fatty amines, which normally contain either one long and two short alkyl groups or two long and one short alkyl group, by oxidation in the presence of hydrogen peroxide. Amine oxides suitable for the purposes of the invention correspond to formula (VI):

(VI)

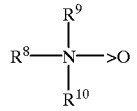

where $R^8$ is a linear or branched alkyl group containing 12 to 18 carbon atoms and $R^9$ and $R^{10}$ independently of one another have the same meaning as $R^8$ or represent an optionally hydroxysubstituted alkyl group containing 1 to 4 carbon atoms. Amine oxides corresponding to formula (VI) in which $R^8$ and $R^9$ represent $C_{12/14}$ or $C_{12/18}$ cocoalkyl radicals and $R^{10}$ is a methyl or hydroxyethyl group are preferably used. Amine oxides corresponding to formula (VI) in which $R^8$ is a $C_{12/14}$ or $C_{12/18}$ cocoalkyl radical and $R^9$ and $R^{10}$ represent a methyl or hydroxyethyl group are also preferred.

Commercial Applications

The formulations according to the invention are distinguished by excellent cleaning power and form a rich, stable foam even in hard water and in the presence of oils. They are highly compatible with the skin and have a sufficiently high viscosity so that, on the one hand, they are easy to dispense in measured quantities by the consumer and, on the other hand, flow off only slowly even on inclined surfaces. They are therefore suitable for the production of manual dishwashing detergents and multipurpose cleaners in which they may be present in quantities of 30 to 100% by weight and preferably in quantities of 50 to 70% by weight, based on the formulation.

Finally, the invention relates to the use of betaines of which the fatty residue contains exactly 12 carbon atoms for the production of formulations for cleaning hard surfaces.

EXAMPLES

Dishwashing performance was determined by the plate test [Fette, Seifen, Anstrichmitt., 74, 163 (1972)]. To this end, plates 14 cm in diameter were soiled with 2 $cm^3$ of beef tallow (acid value 9–10) or 2 $cm^3$ of a mixture of beef tallow and baby pap and stored for 24 h at room temperature. The plates were then rinsed with 5 liters of tapwater (hardness 16° d) at 50° C. The test mixture was used in a quantity of 0.15 g active substance/I. The dishwashing test was terminated when the foam had completely disappeared. The result was expressed as the cleaning performance in relation to a standard commercial product (=100%). Foaming behavior was tested in accordance with DIN 53 902 (Ross-Miles Test II). The basic foam and the foam height after 20 mins. were determined (20° C., 1 g surfactant/I, 16° d, 5 ml olive oil/I). The results are set out in Table 1. Formulations 1 to 4 correspond to the invention while mixtures C1 to C4 are intended for comparison.

TABLE 1

| Cleaning and foaming power | | | | | | | | |
|---|---|---|---|---|---|---|---|---|
| Composition/Performance | 1 | 2 | 3 | 4 | C1 | C2 | C3 | C4 |
| Lauric acid amidopropylbetaine | 10.3 | 7.0 | 10.3 | 10.3 | — | — | — | — |
| Cocoamidopropyl Betaine | — | — | — | — | 10.3 | 7.0 | 10.3 | 10.3 |
| Coco Glucosides | 3.0 | 3.0 | 3.0 | 3.0 | 3.0 | 3.0 | 3.0 | 3.0 |
| Sodium Laureth Sulfate | 14.5 | 21.0 | 14.5 | 14.5 | 14.5 | 21.0 | 14.5 | 14.5 |
| Sodium Lauryl Sulfate | 8.3 | 5.0 | 8.3 | 8.3 | 8.3 | 5.0 | 8.3 | 8.3 |
| Laureth-5 | — | — | 4.0 | — | — | — | 4.0 | — |
| Cocodimethyl Amineoxide | — | — | — | 1.2 | — | — | — | 1.2 |
| Water | | | | to 100 | | | | |
| Cleaning power | | | | | | | | |
| Beef tallow soil [plates] | 115 | 117 | 135 | 125 | 100 | 100 | 100 | 100 |
| Mixed soil [plates] | 104 | 110 | 120 | 118 | 100 | 100 | 100 | 100 |
| Foaming power | | | | | | | | |
| Basic foam [ml] | 110 | 120 | 120 | 125 | 100 | 105 | 110 | 110 |
| Foam height after 20 min [ml] | 95 | 100 | 95 | 100 | 65 | 70 | 65 | 75 |

What is claimed is:

1. A surfactant composition comprising:

(a) from 5 to 15% by weight of a single betaine, wherein the betaine has a fatty residue containing exactly 12 carbon atoms;

(b) from 3 to 18% by weight of an alkyl and/or alkenyl oligoglycoside; and (c) from 20 to 35% by weight of a fatty alcohol ether sulfate, all weights being based on the weight of the composition.

2. The composition of claim 1 wherein the alkyl and/or alkenyl oligoglycoside is present in the composition in an amount of from 5 to 15% by weight, based on the weight of the composition.

3. The composition of claim 1 wherein the fatty alcohol ether sulfate is present in the composition in an amount of from 20 to 25% by weight, based on the weight of the composition.

4. The composition of claim 1 further comprising up to 5% by weight, based on the weight of the composition, of a fatty alcohol ethoxylate.

5. The composition of claim 4 wherein the fatty alcohol ethoxylate is present in the composition in an amount of from 1 to 3% by weight, based on the weight of the composition.

6. The composition of claim 1 further comprising up to 5% by weight, based on the weight of the composition, of an amine oxide.

7. The composition of claim 6 wherein the amine oxide is present in the composition in an amount of from 1 to 3% by weight, based on the weight of the composition.

8. A hard surface cleaning composition containing from 30 to 100% by weight of the surfactant composition of claim 1.

9. The composition of claim 8 wherein the surfactant composition is present in an amount of from 50 to 70% by weight, based on the weight of the hard surface cleaning composition.

10. A process for cleaning a hard surface comprising contacting the surface with a composition containing:

(a) from 5 to 15% by weight of a single betaine wherein the betaine has a fatty residue containing exactly 12 carbon atoms;

(b) from 3 to 18% by weight of an alkyl and/or alkenyl oligoglycoside; and (c) from 20 to 35% by weight of a fatty alcohol ether sulfate, all weights being based on the weight of the composition.

11. The process of claim 10 wherein the alkyl and/or alkenyl oligoglycoside is present in the composition in an amount of from 5 to 15% by weight, based on the weight of the composition.

12. The process of claim 10 wherein the fatty alcohol ether sulfate is present in the composition in an amount of from 20 to 25% by weight, based on the weight of the composition.

13. The process of claim 10 wherein the composition further comprises up to 5% by weight, based on the weight of the composition, of a fatty alcohol ethoxylate.

14. The process of claim 13 wherein the fatty alcohol ethoxylate is present in the composition in an amount of from 1 to 3% by weight, based on the weight of the composition.

15. The process of claim 10 wherein the composition further comprises up to 5% by weight, based on the weight of the composition, of an amine oxide.

16. The process of claim 15 herein the amine oxide is present in the composition in an amount of from 1 to 3% by weight, based on the weight of the composition.

* * * * *